US010283288B2

(12) United States Patent
Li et al.

(10) Patent No.: US 10,283,288 B2
(45) Date of Patent: May 7, 2019

(54) VACUUM SWITCHING APPARATUS, AND CONTACT ASSEMBLY AND METHOD OF SECURING AN ELECTRICAL CONTACT TO AN ELECTRODE THEREFOR

(71) Applicant: EATON CORPORATION, Cleveland, OH (US)

(72) Inventors: Yucheng Li, Suzhou (CN); Wangpei Li, Horseheads, NY (US); Jun Yan, Suzhou (CN); Xuefei Chen, Suzhou (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 60 days.

(21) Appl. No.: 15/484,160

(22) Filed: Apr. 11, 2017

(65) Prior Publication Data

US 2017/0221651 A1 Aug. 3, 2017

Related U.S. Application Data

(62) Division of application No. 14/542,765, filed on Nov. 17, 2014, now Pat. No. 9,704,658.

(51) Int. Cl.

| | |
|---|---|
| ***H01H 11/04*** | (2006.01) |
| ***H01H 33/66*** | (2006.01) |
| ***H01H 1/58*** | (2006.01) |
| ***H01H 33/664*** | (2006.01) |
| *H01H 33/662* | (2006.01) |

(52) U.S. Cl.

CPC ..... *H01H 11/04* (2013.01); *H01H 1/58* (2013.01); *H01H 11/042* (2013.01); (Continued)

(58) Field of Classification Search

CPC ..... H01H 33/66; H01H 33/664; H01H 33/66207; H01H 1/58; H01H 11/04; (Continued)

(56) References Cited

U.S. PATENT DOCUMENTS 1,752,799 A * 4/1930 Junkers ..... B21J 15/46 192/103 C
3,412,594 A * 11/1968 Lund ..... B21J 15/048 29/243.521

(Continued)

FOREIGN PATENT DOCUMENTS

JP S49 6472 A 1/1974

OTHER PUBLICATIONS

European Patent Office, "International Search Report and Written Opinion" (for corresponding application PCT/US2015/054371), dated Dec. 17, 2015, 12 pp.

*Primary Examiner* — Bayan Salone
(74) *Attorney, Agent, or Firm* — Eckert Seamans

(57) ABSTRACT

A contact assembly is for a vacuum switching apparatus. The vacuum switching apparatus includes a vacuum envelope. The vacuum envelope has an interior. The contact assembly includes: a number of electrical contacts located in the interior of the vacuum envelope, at least one electrical contact having a hole; and a number of electrodes each engaging a corresponding one of the number of electrical contacts, at least one electrode including a base and a protrusion. The protrusion extends from the base into the hole of the electrical contact in order to secure the electrical contact to the electrode.

15 Claims, 5 Drawing Sheets

(52) U.S. Cl.
CPC ..... *H01H 33/664* (2013.01); *H01H 33/66* (2013.01); *H01H 33/662* (2013.01); *H01H 33/66207* (2013.01); *Y10T 29/49908* (2015.01); *Y10T 29/49938* (2015.01); *Y10T 29/49943* (2015.01); *Y10T 29/49954* (2015.01); *Y10T 29/49956* (2015.01)

(58) Field of Classification Search
CPC ..... H01H 11/042; Y10T 29/49943; Y10T 29/49954; Y10T 29/49956; Y10T 29/49938; Y10T 29/49908; Y10T 29/49909; Y10T 29/53717
USPC .... 218/118, 120, 123, 127, 146; 29/243.517
See application file for complete search history.

(56) References Cited

U.S. PATENT DOCUMENTS 3,576,960 A * 5/1971 Kurtz ..... H01H 33/6643 218/127
4,473,731 A 9/1984 Yorita
5,398,537 A * 3/1995 Michalewski ..... B21J 15/24 29/243.54
5,486,662 A 1/1996 Takiishi
5,588,323 A * 12/1996 Peterson ..... B21J 15/30 29/243.53
7,173,208 B2 * 2/2007 Harada ..... H01H 33/6644 218/118
8,039,771 B2 * 10/2011 Trondsen ..... H01H 33/66261 218/10
8,507,822 B2 8/2013 Li
8,575,509 B2 11/2013 Marchand et al.
8,653,396 B2 2/2014 Li et al.
8,861,144 B2 10/2014 Shea et al.
9,015,920 B2 * 4/2015 Mauer ..... B21J 15/025 29/243.53
2002/0144977 A1 10/2002 Kikuchi et al.
2012/0180301 A1 * 7/2012 Cooke ..... B23P 19/062 29/505
2013/0081242 A1 * 4/2013 LeMieux ..... B21J 15/10 29/243.53
2014/0048514 A1 * 2/2014 Balasubramanian ..... H01H 11/041 218/124

* cited by examiner

VACUUM SWITCHING APPARATUS, AND CONTACT ASSEMBLY AND METHOD OF SECURING AN ELECTRICAL CONTACT TO AN ELECTRODE THEREFOR

CROSS-REFERENCE TO RELATED APPLICATION

This application is a division of application Ser. No. 14/542,765, filed Nov. 17, 2014, and entitled "VACUUM SWITCHING APPARATUS, AND CONTACT ASSEMBLY AND METHOD OF SECURING AN ELECTRICAL CONTACT TO AN ELECTRODE THEREFOR" the contents of which are incorporated herein by reference.

BACKGROUND

Field

The disclosed concept pertains generally to vacuum switching apparatus and, more particularly, to vacuum switching apparatus such as for example, vacuum interrupters. The disclosed concept also pertains to contact assemblies for vacuum switching apparatus. The disclosed concept further pertains to methods of securing an electrical contact to an electrode in vacuum switching apparatus.

Background Information

Some circuit breakers such as, for example, power circuit breakers, employ vacuum interrupters as the switching devices. Vacuum interrupters generally include separable electrical contacts disposed on the ends of corresponding electrodes within an insulating housing. The electrical contacts are typically mechanically and electrically connected to the electrodes by brazing. While further components of the vacuum interrupter are being assembled with the electrode/electrical contact assembly, it is important to keep the mating between the electrode/electrical contact secured. Known practices for securing this connection involve employing a contact weight on top of the electrical contact. However, employing a contact weight has disadvantages. For example, while the vacuum interrupter is brazed in a furnace, the contact weight requires an additional expenditure of energy by the furnace. Additionally, employing a contact weight creates a risk that the electrical contacts will not be properly positioned, which can result in poor brazing of the joint between them, leading to an undesirable increase in electrical resistance of that joint and of the entire vacuum interrupter. There are also situations when the use of a positioning weight is prohibited, for example and without limitation, when the entire vacuum interrupter is to be brazed in a single vacuum brazing furnace run.

There is, therefore, room for improvement in vacuum switching apparatus, and in contact assemblies and methods of securing an electrical contact to an electrode therefor.

SUMMARY

These needs and others are met by embodiments of the disclosed concept, which are directed to a contact assembly and associated method of securing an electrical contact to an electrode in vacuum switching apparatus.

In accordance with one aspect of the disclosed concept, a contact assembly for a vacuum switching apparatus is provided. The vacuum switching apparatus includes a vacuum envelope. The vacuum envelope has an interior. The contact assembly comprises: a number of electrical contacts disposed in the interior of the vacuum envelope, at least one electrical contact having a hole; and a number of electrodes each engaging a corresponding one of the number of electrical contacts, at least one electrode comprising a base and a protrusion. The protrusion extends from the base into the hole of the electrical contact in order to secure the electrical contact to the electrode.

As another aspect of the disclosed concept, a vacuum switching apparatus comprises: a vacuum envelope having an interior; and a contact assembly comprising: a number of electrical contacts disposed in the interior of the vacuum envelope, at least one electrical contact having a hole, and a number of electrodes each engaging a corresponding one of the number of electrical contacts, at least one electrode comprising a base and a protrusion. The protrusion extends from the base into the hole of the electrical contact in order to secure the electrical contact to the electrode.

As another aspect of the disclosed concept, a method of securing an electrical contact to an electrode in a vacuum switching apparatus is provided. The vacuum switching apparatus includes a vacuum envelope having an interior. The electrode comprises a base and a protrusion extending from the base. The electrical contact has a hole. The electrical contact is disposed in the interior of the vacuum envelope. The method comprises the steps of: inserting the protrusion into the hole of the electrical contact; and deforming the protrusion in order to secure the electrical contact to the electrode.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
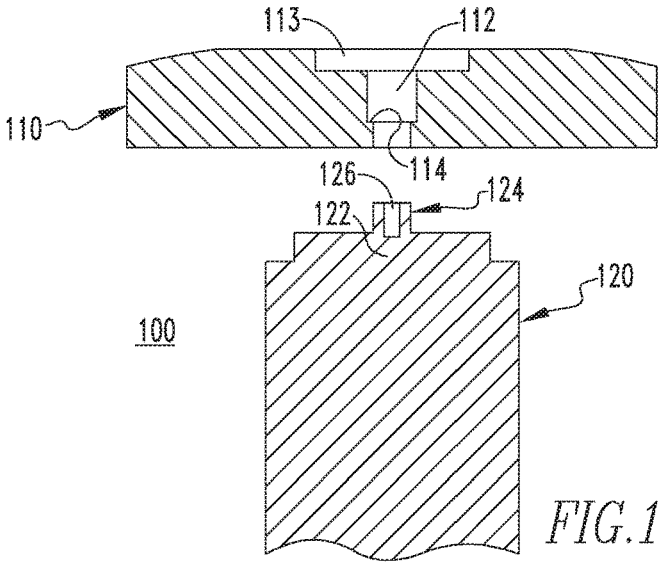
FIG. 1 is a simplified section view of a contact assembly in accordance with an embodiment of the disclosed concept, shown before the electrical contact is secured to the electrode.

For purposes of the description hereinafter, directional phrases used herein such as, for example "up", "down", "top", "bottom", and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" or "affixed" shall mean that the parts are joined together directly.

As employed herein, the statement that two or more parts or components "engage" one another shall mean that the parts touch and/or exert a force against one another either directly or through one or more intermediate parts or components.

As employed herein, the term "coupling member" refers to any suitable connecting or tightening mechanism expressly including, but not limited to, screws, rivets, bolts and the combinations of bolts and nuts (e.g., without limitation, lock nuts) and bolts, washers and nuts.

As employed herein, the term "vacuum envelope" means an envelope employing a partial vacuum therein.

Figure 2:
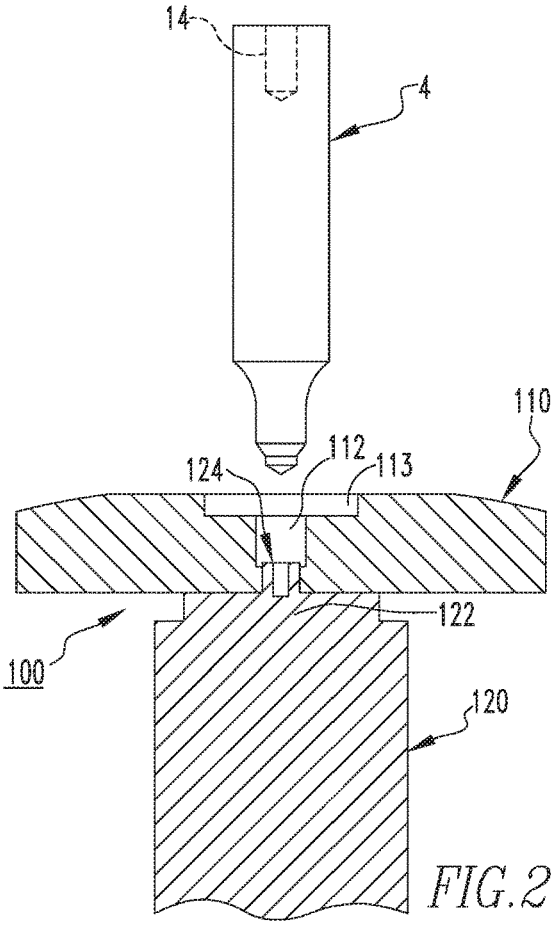
FIG. 2 is a simplified section view of the contact assembly of FIG. 1, shown with the electrode extending into the electrical contact and with a component of a tooling apparatus.
Figure 5:
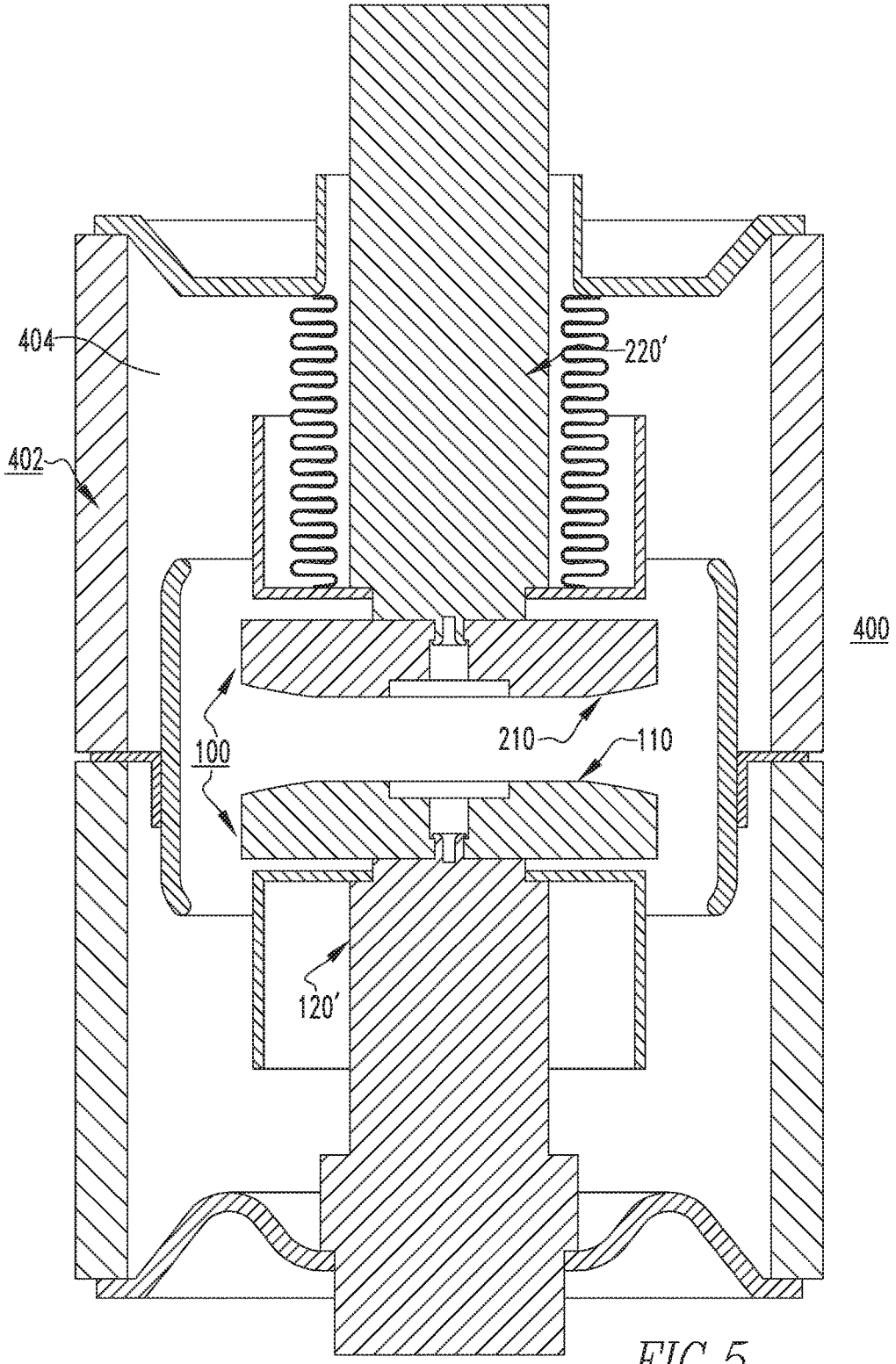
FIG. 5 is a section view of a vacuum switching apparatus and contact assembly therefor, in accordance with an embodiment of the disclosed concept.

FIG. 1 shows a contact assembly 100 (shown in simplified form) for a vacuum switching apparatus such as, for example and without limitation, a vacuum interrupter 400 (shown in simplified form in FIG. 5). In the example of FIG. 1, the contact assembly 100 includes an electrical contact 110 and an electrode 120, before the electrical contact 110 has been secured to the electrode 120. As seen, the electrical contact 110 has a hole (e.g., without limitation, thru hole 112), and the electrode 120 includes a base 122 and a protrusion 124 extending from the base 122. The protrusion 124 has a cavity 126, the purpose of which will be described below. In operation, the protrusion 124 extends into the thru hole 112 in order to secure the electrical contact 110 to the electrode 120 (see for example FIG. 2, which shows the electrode 120 engaging the electrical contact 110).

Figure 3:
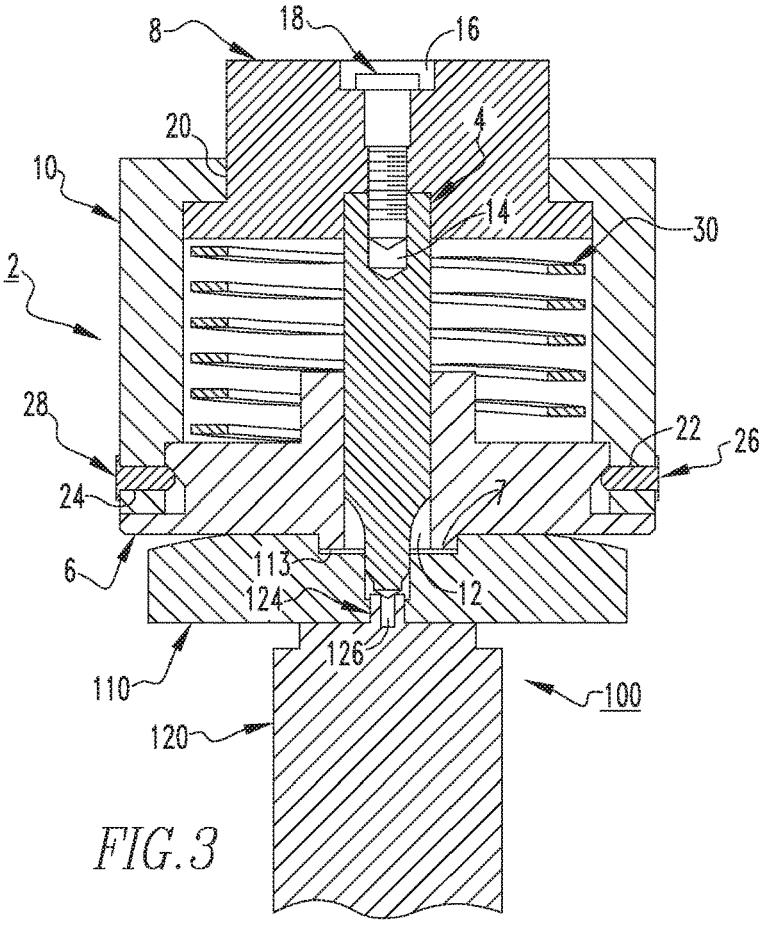
FIG. 3 is a simplified section view of the contact assembly and component of the tooling apparatus of FIG. 2, also showing additional features of the tooling apparatus.

FIG. 3 shows a tooling apparatus 2 mounted on the contact assembly 100. The tooling apparatus 2 generally includes a component (e.g., without limitation, rivet tool 4), a body portion 6, a cap 8, and a housing 10. The body portion 6 has a thru hole 12. In order to assemble the tooling apparatus 2, the rivet tool 4 is inserted through the thru hole 12. The cap 8 has a thru hole 16. The tooling apparatus 2 further includes a number of coupling members (three coupling members 18,26,28 are shown). To secure the cap 8 to the rivet tool 4, the coupling member 18 is inserted into the thru hole 16 of the cap 8 and an aperture 14 (shown in hidden line drawing in FIG. 2) of the rivet tool 4. In order to secure the housing 10 to each of the body portion 6 and the cap 8, and therefore to the rivet tool 4, the housing 10 is placed on the cap 8 such that the cap 8 extends through a corresponding thru hole 20 (three thru holes 20,22,24 are shown in FIG. 3). Similarly, the coupling members 26,28 are inserted through the respective thru holes 22,24 and engage the body portion 6.

The tooling apparatus 2 includes a spring 30 that extends from the body portion 6 to the cap 8. The rivet tool 4 extends through the spring 30. The spring 30 exerts a force on the body portion 6 and on the cap 8. In operation, the tooling apparatus 2 secures the electrical contact 110 to the electrode 120. For example and without limitation, when the rivet tool 4 moves into the thru hole 112 toward the base 122 of the electrode 120, and the rivet tool 4 pushes into the protrusion 124, the protrusion 124 plastically deforms.

Figure 4A:
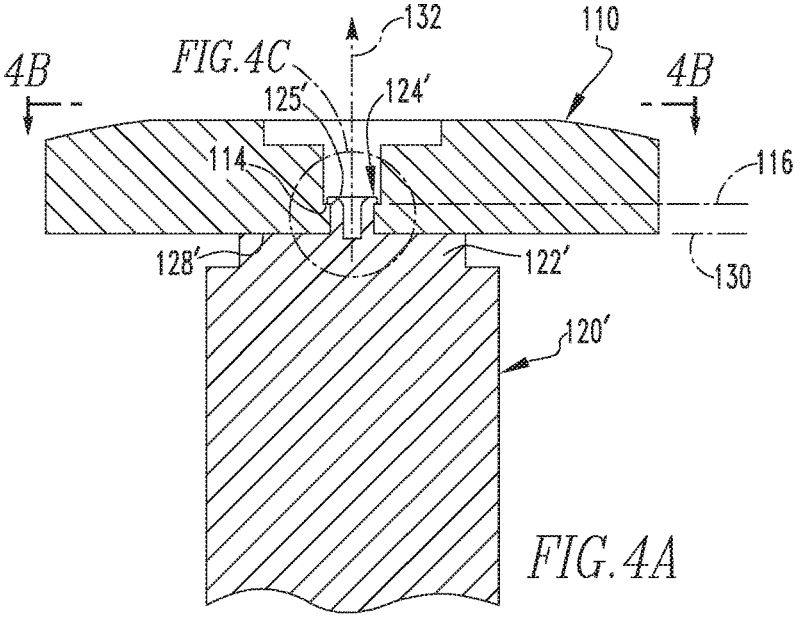
FIG. 4A is a simplified section view of the contact assembly of FIG. 2, modified to show the electrical contact secured to the electrode.

More specifically, when the cap 8 moves toward the electrical contact 110 (i.e., movement initiated by an operator), the cap 8 pushes into the rivet tool 4, which in turn is driven into the cavity 126 of the electrode 120, plastically deforming the protrusion 124 of the electrode 120 to form an electrode 120', as shown in FIG. 4A (it will be appreciated that like reference numbers are used to represent like features in FIG. 4A). This process is known as "staking" the rivet (i.e., the protrusion 124), and it provides a mechanism to attach two components (i.e., the electrode 120' is attached to the electrical contact 110). In other words, by deforming (i.e., staking) the protrusion 124, the electrical contact 110 is secured to the resulting electrode 120', which is advantageously prevented from being pulled through the electrical contact 110.

As the cap 8 moves toward the electrical contact 110, the force exerted by the spring 30 on each of the body portion 6 and the cap 8 advantageously increases. In this manner, the amount of plastic deformation can be relatively controlled. For example and without limitation, although it is within the scope of the disclosed concept for the rivet tool 4, or a similar suitable alternative tool (not shown), to perform the desired deforming function without the other components of the tooling apparatus 2 (see for example FIG. 2, in which only the rivet tool 4 is shown), employing the tooling apparatus 2 allows the amount of force exerted on the protrusion 124 to be controlled. Specifically, by having the opposing force of the spring 30 on the cap 8, and by having that force increase as the cap 8 moves toward the electrical contact 110, the tooling apparatus 2 advantageously provides a controlled mechanism to deform the protrusion 124, as desired.

When the rivet tool 4 is performing the desired deforming function, the body portion 6 of the tooling apparatus 2 is advantageously aligned with the contact assembly 100. As seen in FIG. 3, the thru hole 112 of the electrical contact 110 has a receiving portion 113, and the body portion 6 of the tooling apparatus 2 includes a securing portion 7 that fits in the receiving portion 113. When the securing portion 7 is located in the receiving portion 113, the rivet tool 4 is positioned directly on top of the cavity 126. As a result, when the rivet tool 4 drives down into the cavity 126 of the protrusion 124, the rivet tool 4 is advantageously able to plastically deform the protrusion 124 to form a consistent annular-shaped retaining portion 125'. It is, however, within the scope of the disclosed concept for an electrical contact (not shown) and body portion (not shown) to have any suitable alternative shape and/or configuration in order to perform the desired function of aligning the rivet tool 4 with the cavity 126.

Figure 4B:
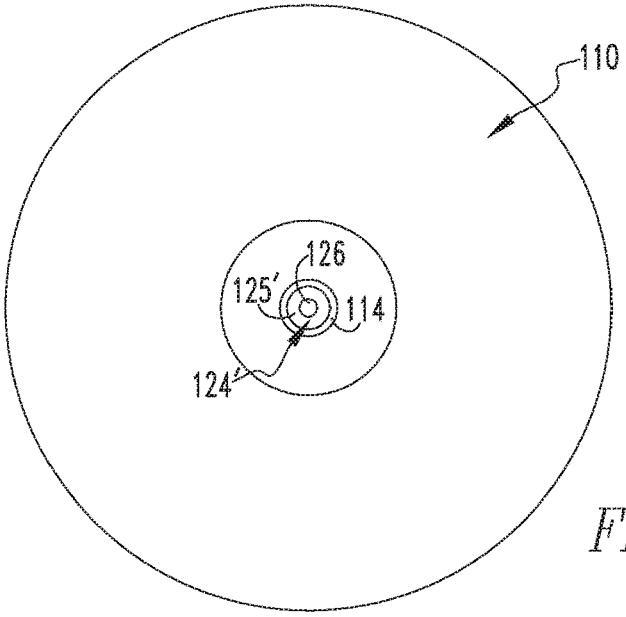
FIG. 4B is a simplified top plan view of the contact assembly of FIG. 4A.
Figure 4C:
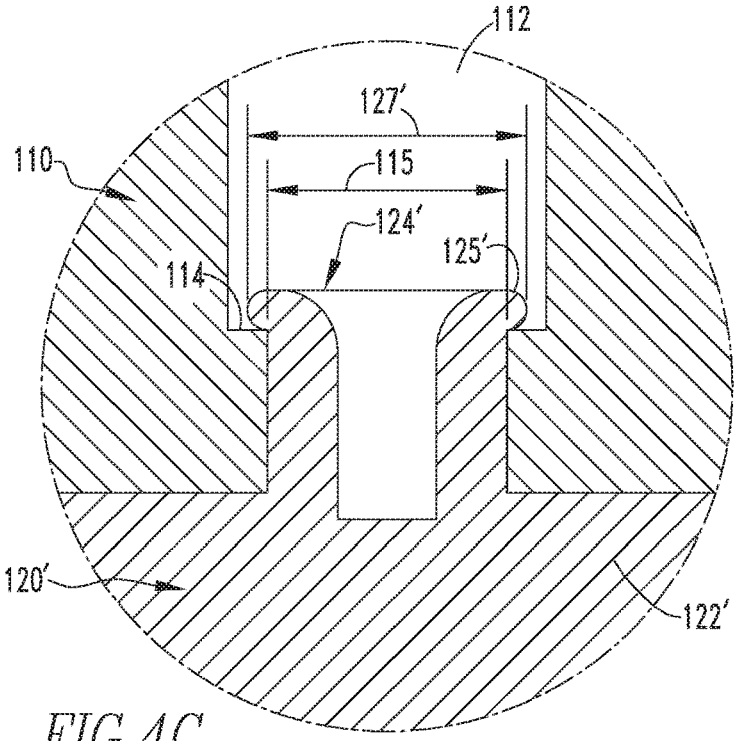
FIG. 4C is an enlarged section view of a portion of the contact assembly of FIG. 4A.

Referring to FIGS. 4B and 4C, the electrical contact 110 includes an annular-shaped internal ledge 114 located adjacent the thru hole 112 (FIG. 4C). As seen in FIG. 4C, the protrusion 124' extends from the base 122' past the internal ledge 114. The retaining portion 125' substantially overlays and engages the internal ledge 114. The retaining portion 125' has an outer diameter 127' that is larger than an inner diameter 115 of the internal ledge 114. In this manner, the retaining portion 125' advantageously prevents the electrode 120' from becoming detached from (i.e., pulled through) the electrical contact 110, thus securing the electrical contact 110 to the electrode 120'.

This connection advantageously allows the electrode 120' and the electrical contact 110 to be brazed in a single furnace run with the rest of the vacuum interrupter 400 (FIG. 5).

Additionally, employing the disclosed riveting concept allows the electrical contact 110 and the electrode 120' to be more tightly mated together. As a result, the quality of the vacuum brazing is advantageously improved, because when the braze melts, it weeps up better along the tighter joint. Furthermore, known methods of securing an electrical contact (not shown) to an electrode (not shown) involving contact weights (not shown) can be eliminated. Consequently, when the vacuum interrupters 400,500 undergo brazing, undesirable expenditures of energy previously associated with contact weights (not shown) can be eliminated.

Referring again to FIG. 4A, the base 122' of the electrode 120' includes an engaging surface 128' that engages the electrical contact 110 and faces in a direction 132. The engaging surface 128' is located in a plane 130 and the internal ledge 114 is located in a plane 116 that is parallel to the plane 130. The direction 132 that the engaging surface 128' faces is perpendicular to the planes 116,130. More precisely, the engaging surface 128' is substantially flush with the electrical contact 110 and exerts a force on the electrical contact 110 in the direction 132. The retaining portion 125' exerts an opposing force on the electrical contact 110 in a direction opposite the direction 132. Because the planes 116,130 are parallel to each other, the retaining portion 125' and the engaging surface 128' are advantageously able to provide a maximum clamping force on the electrical contact 110 to secure the electrical contact 110 to the electrode 120'. This configuration advantageously provides a relatively strong securement of the electrode 120' and the electrical contact 110 to prevent them from moving out of position while the contact assembly 100 is further processed. Additionally, the configuration provides a relatively tight geometric fit between the electrode 120' and the electrical contact 110, advantageously allowing for a relatively void free mechanical and electrical connection.

FIG. 5 shows the aforementioned vacuum interrupter 400, including the contact assembly 100 and a vacuum envelope 402. The contact assembly 100 further includes another electrical contact 210 and a corresponding electrode 220' engaging the electrical contact 210. As seen, the vacuum envelope 402 has an interior 404 and each of the electrical contacts 110,210 are located in the interior 404. The electrical contact 210 is opposite the electrical contact 110. Additionally, it will be appreciated that the electrical contact 210 is secured to the electrode 220' in substantially the same manner as the electrode 120' and the electrical contact 110. Thus, advantages associated with the relatively secure mechanical/electrical connection between the electrode 120' and the electrical contact 110 likewise apply to the electrode 220' and the electrical contact 210.

Figure 6:
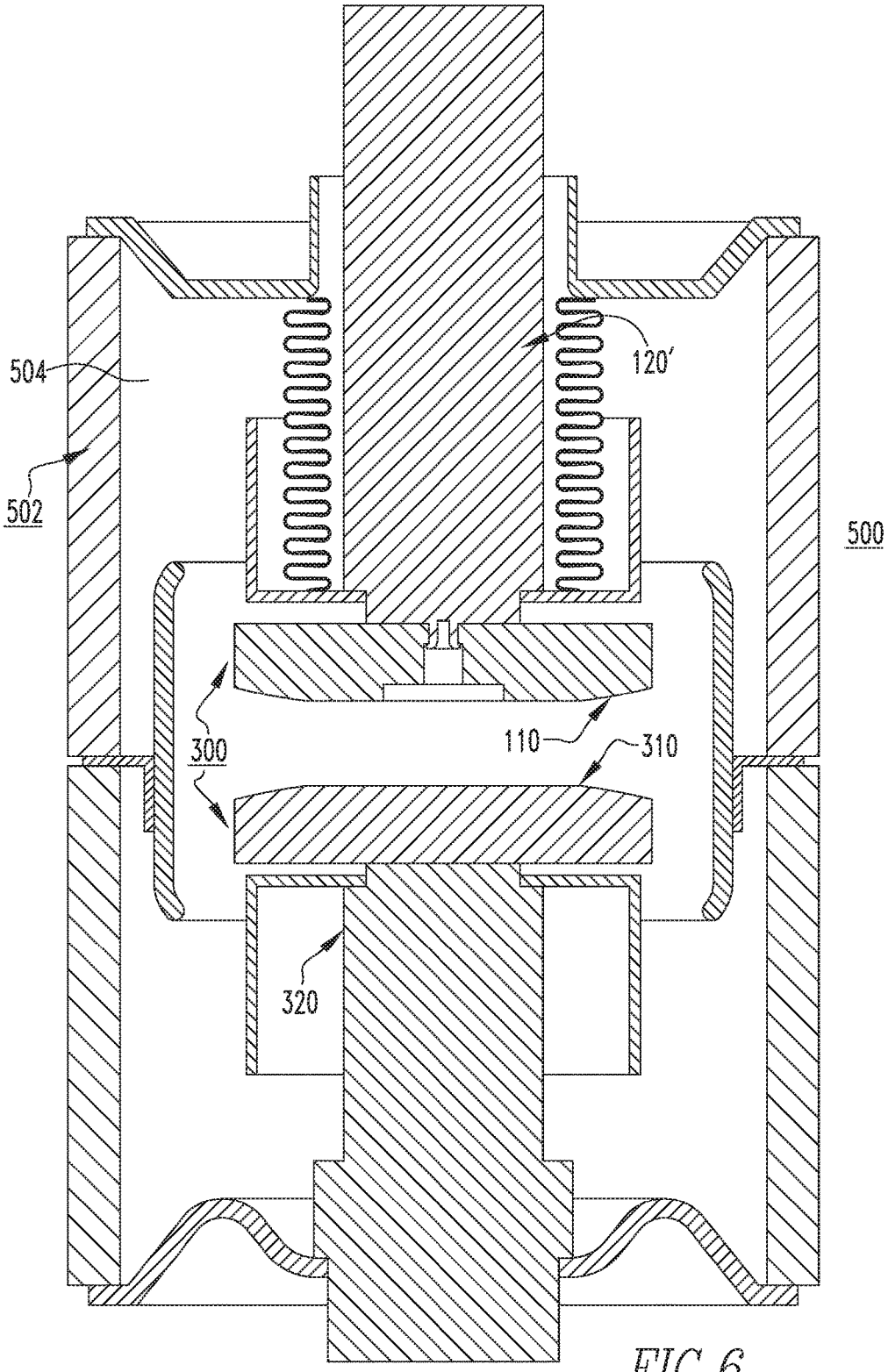
FIG. 6 is a section view of a vacuum switching apparatus and contact assembly therefor, in accordance with an alternative embodiment of the disclosed concept.

FIG. 6 shows another electrical switching apparatus (e.g., without limitation, vacuum interrupter 500) that includes a vacuum envelope 502 having an interior 504, and a contact assembly 300. The contact assembly 300 includes the electrical contact 110 and the corresponding electrode 120'. In addition, the contact assembly 300 includes another electrical contact 310 and an electrode 320 engaging the electrical contact 310. The electrical contacts 110,310 are opposite each other and are located in the interior 504 of the vacuum envelope 502. The electrode 320 does not extend into the electrical contact 310. It will be appreciated that the electrical contact 310 may be secured to the electrode 320 by any known method (e.g., without limitation, brazing). Thus, the contact assembly 300 and associated vacuum interrupter 500 include the electrical contact 110 and associated electrode 120' secured in accordance with the disclosed staking concept, as well as the electrical contact 310 and associated electrode 320 secured in accordance with known methods.

Accordingly, it will be appreciated that the disclosed concept provides for an improved (e.g., without limitation, easier to manufacture, more energy efficient, stronger mechanical/electrical connection between electrode/electrical contact) vacuum switching apparatus (e.g., without limitation, vacuum interrupters 400,500), and contact assembly 100,300 and method of securing an electrical contact 110, 210 to an electrode 120',220' therefor, which among other benefits, deforms (i.e., stakes) the protrusion 124 of the electrode 120 in a controlled manner, as desired. Thus, a portion (i.e., retaining portion 125') of the resulting electrode 120' advantageously prevents the electrode 120' from being pulled through the electrical contact 110, thus securing the electrical contact 110 to the electrode 120'.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A method of securing an electrical contact to an electrode in a vacuum switching apparatus, said vacuum switching apparatus including a vacuum envelope having an interior, said electrode comprising a base and a protrusion extending from said base, said electrical contact having a hole, said electrical contact being disposed in the interior of the vacuum envelope, said method comprising the steps of:

inserting said protrusion into the hole of said electrical contact;

deforming said protrusion in order to secure said electrical contact to said electrode, wherein the deforming step further comprises:

providing a tooling apparatus comprising a component, a body portion, a cap having an extended position and being coupled to said component, and a housing coupled to said body portion, said component extending through said body portion, said cap extending through said housing and being movable with respect to both said body portion and said housing comprising an element and a flange portion extending radially outwardly from said element, said housing comprising a cylindrical-shaped portion and a lip portion extending radially inwardly from the cylindrical-shaped portion, the lip portion being structured to overlay and engage said flange portion in order to prevent said cap from moving beyond the extended position;

moving said component into the hole of said electrical contact toward said base of said electrode; and pushing said component into said protrusion in order to deform said protrusion.

2. The method of claim 1 wherein said body portion has a thru hole; and wherein the method further comprises:

inserting said component through the thru hole of said body portion; and securing said cap to said component.

3. The method of claim 2 wherein said tooling apparatus further comprises a coupling member; wherein said component has an aperture; and wherein the securing step further comprises:

inserting said coupling member into the aperture of said component.

4. The method of claim 3 wherein said cap has a thru hole; and wherein the method further comprises:

inserting said coupling member into the thru hole of said cap before inserting said coupling member into the aperture of said component.

5. The method of claim 3 wherein said housing has a number of thru holes; and wherein the method further comprises:

placing said housing on said cap, said cap extending through one of the thru holes of said housing.

6. The method of claim 5 further comprising:

inserting a number of other coupling members through a corresponding number of other thru holes of said housing, each of said number of other coupling members engaging said body portion.

7. The method of claim 2 wherein said tooling apparatus further comprises a spring; wherein said spring extends from said body portion to said cap; wherein said component extends through said spring; wherein said spring exerts a force on each of said cap and said body portion; and wherein the pushing step further comprises:

moving said cap toward said electrical contact, thereby increasing the force exerted by said spring on each of said cap and said body portion.

8. The method of claim 1 wherein said electrical contact has an internal ledge; wherein said protrusion has a cavity; and wherein the pushing step further comprises:

driving said component into the cavity, thereby forcing a portion of said protrusion to substantially overlay said internal ledge.

9. The method of claim 8 further comprising:

providing said base with an engaging surface engaging said electrical contact, said engaging surface being disposed in a first plane; and disposing said internal ledge in a second plane parallel to the first plane.

10. The method of claim 1 further comprising:

providing said electrode as a single unitary component made from a single piece of material.

11. The method of claim 1 wherein said tooling apparatus further comprises a spring; and wherein said body portion at least partially extends into said spring.

12. The method of claim 1 wherein said tooling apparatus further comprises a spring; and wherein said spring engages each of said cap and said body portion.

13. A method of securing an electrical contact to an electrode in a vacuum switching apparatus, said vacuum switching apparatus including a vacuum envelope having an interior, said electrode comprising a base and a protrusion extending from said base, said electrical contact having a hole, said electrical contact being disposed in the interior of the vacuum envelope, said method comprising the steps of:

inserting said protrusion into the hole of said electrical contact;

deforming said protrusion in order to secure said electrical contact to said electrode, wherein the deforming step further comprises:

providing a tooling apparatus comprising a component, a body portion separate and distinct from said component, a cap having an extended position and being coupled to said component, a housing coupled to said body portion, and a spring, said body portion at least partially extending through said spring, said cap comprising an element and a flange portion extending radially outwardly from said element, said housing comprising a cylindrical-shaped portion and a lip portion extending radially inwardly from the cylindrical-shaped portion, the lip portion being structured to overlay and engage said flange portion in order to prevent said cap from moving beyond the extended position;

moving said component into the hole of said electrical contact toward said base of said electrode; and pushing said component into said protrusion in order to deform said protrusion.

14. The method of claim 13 wherein said spring engages each of said cap and said body portion.

15. A method of securing an electrical contact to an electrode in a vacuum switching apparatus, said vacuum switching apparatus including a vacuum envelope having an interior, said electrode comprising a base and a protrusion extending from said base, said protrusion having a cavity, said electrical contact having a hole, said electrical contact being disposed in the interior of the vacuum envelope, said method comprising the steps of:

inserting said protrusion into the hole of said electrical contact;

providing a tooling apparatus comprising a component having a distal portion, a cap having an extended position and being coupled to said component, and a housing structured to engage said cap, said cap comprising an element and a flange portion extending radially outwardly from said element, said housing comprising a cylindrical-shaped portion and a lip portion extending radially inwardly from the cylindrical-shaped portion, the lip portion being structured to overlay and engage said flange portion in order to prevent said cap from moving beyond the extended position;

moving said component into the hole of said electrical contact toward said base of said electrode; and pushing said distal portion of said component into said cavity of said protrusion in order to deform said protrusion.

* * * * *